US005092225A

United States Patent [19]

Sells

[11] Patent Number: 5,092,225

[45] Date of Patent: Mar. 3, 1992

[54] ROOF RIDGE VENT

[76] Inventor: Gary L. Sells, 16250 Petro Dr., Mishawaka, Ind. 46544

[21] Appl. No.: 496,062

[22] Filed: Mar. 16, 1990

Related U.S. Application Data

[63] Continuation of Ser. No. 331,847, Apr. 3, 1989, abandoned.

[51] Int. Cl.[5] ..... F24F 7/02

[52] U.S. Cl. ..... 454/365; 52/199

[58] Field of Search ..... 52/57, 199; 98/42.2, 98/42.21

[56] References Cited

U.S. PATENT DOCUMENTS

| | | | |
|---|---|---|---|
| 2,799,214 | 7/1957 | Roose | 98/42.21 |
| 3,236,170 | 2/1966 | Meyer et al. | 98/42.21 |
| 3,949,657 | 4/1976 | Sells | 98/42.21 |
| 4,280,399 | 7/1981 | Cunning | 98/42.21 |
| 4,558,637 | 12/1985 | Mason | 98/42.21 |
| 4,803,813 | 2/1989 | Fiterman | 98/42.21 X |

*Primary Examiner*—Harold Joyce

*Attorney, Agent, or Firm*—Thomas J. Dodd

[57] ABSTRACT

A ridge vent for a roof which includes a cover plate and return bent undulating baffles to allow for ventilation of air. The vent is formed of flexible material to allow it to be conformed to virtually any shape of roof.

3 Claims, 2 Drawing Sheets 10
20
28
27
18
28
24
22
16
28
26
24
22
27
16
14
12
12

ROOF RIDGE VENT

This is a continuation of co-pending application Ser. No. 331,847 filed on Apr. 3, 1989 abandoned.

SUMMARY OF THE INVENTION

This invention relates to roof ridge vents and will have application to a one piece roof ridge vent and cover plate.

Heretofore, one-piece roof ridge vents have been constructed as shown in U.S. Pat. No. 4,280,399, issued July 28, 1981 to Cunning. These vents were formed of flexible metal or plastic and included peak portions and valley portions which defined air flow baffles to allow air communication between the inside of a structure and outside air. Shingles or similar roof coverings overlaid and were supported atop the vent as shown in the above referenced patent. The shingles and baffles were fastened to the roof by nails or studs.

The roof ridge vent of this invention includes a one piece cover plate and baffle system which overlies the roof and supports the roof covering. The cover plate provides additional support for the roof covering, and also acts as a deflector of moisture should a hole in the covering develop to prevent ingress of moisture into the structure.

Accordingly, it is an object of this invention to provide for an improved roof ridge vent.

Another object is to provide for a one-piece roof ridge vent which adequately supports the roof covering.

Another object is to provide for a one-piece roof ridge vent which provides an additional moisture barrier to guard against ingress of water.

Other objects will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

Figure 1:
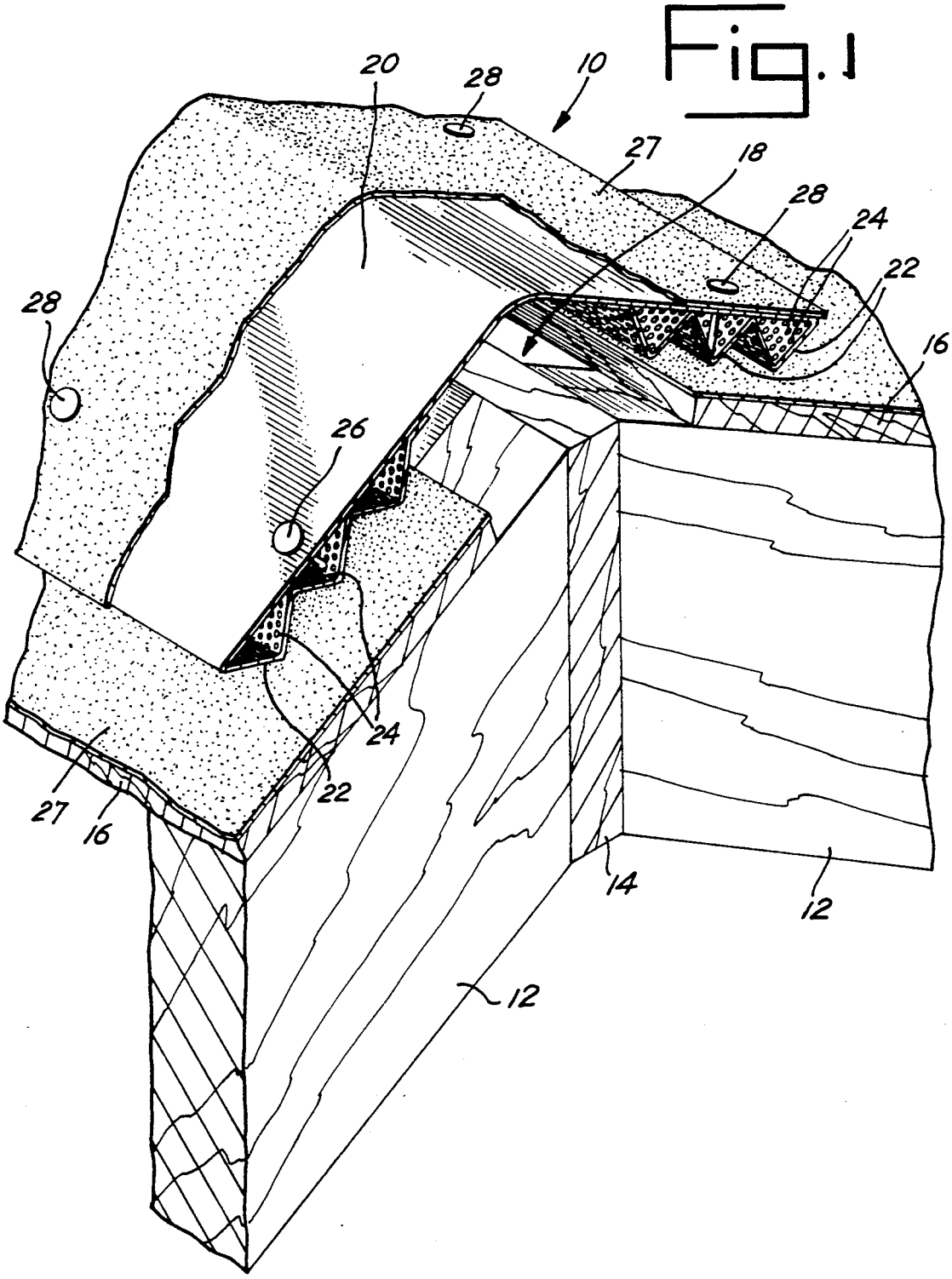
FIG. 1 is a fragmented perspective view of the roof ridge vent of this invention shown in use on a roof with portions of the roof covering cut away for purposes of illustration.
Figure 2:
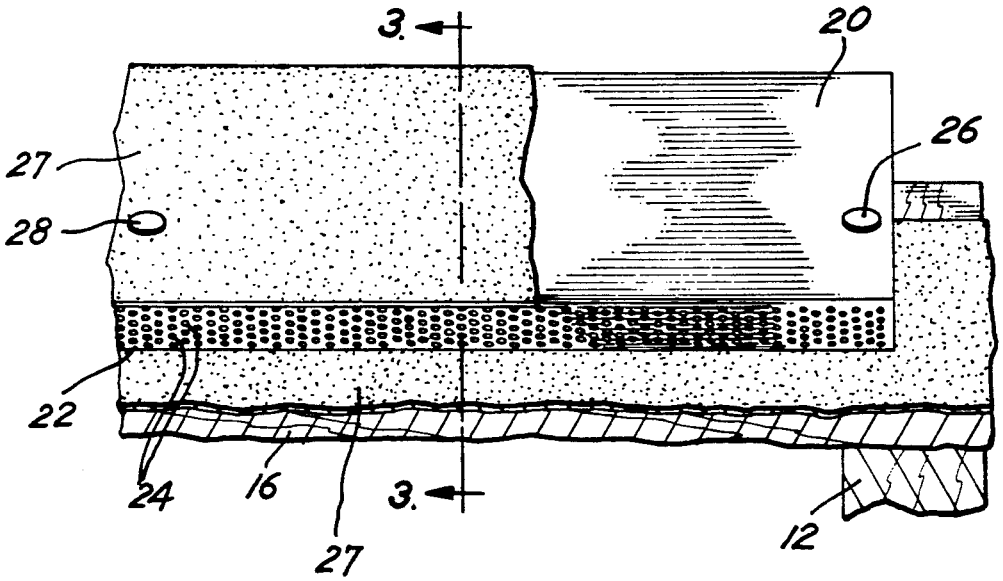
FIG. 2 is a fragmented side elevation view of the vent of FIG. 1.

The preferred embodiment herein described is not intended to be exhaustive or to limit the invention to the precise form disclosed. It is chosen and described to explain the principles of the invention and it application and practical use to enable others skilled in the art to utilize the invention.

Referring to the drawings, reference numeral 10 refers generally to the roof ridge vent of this invention. Vent 10 is shown in use on a conventional slanted roof which includes transversely spaced rafters 12 joined to ridge pole 14. Sheathing 16 overlies and is connected to rafters 12 spaced from ridge pole 14 to define a vent opening 18.

Figure 3:
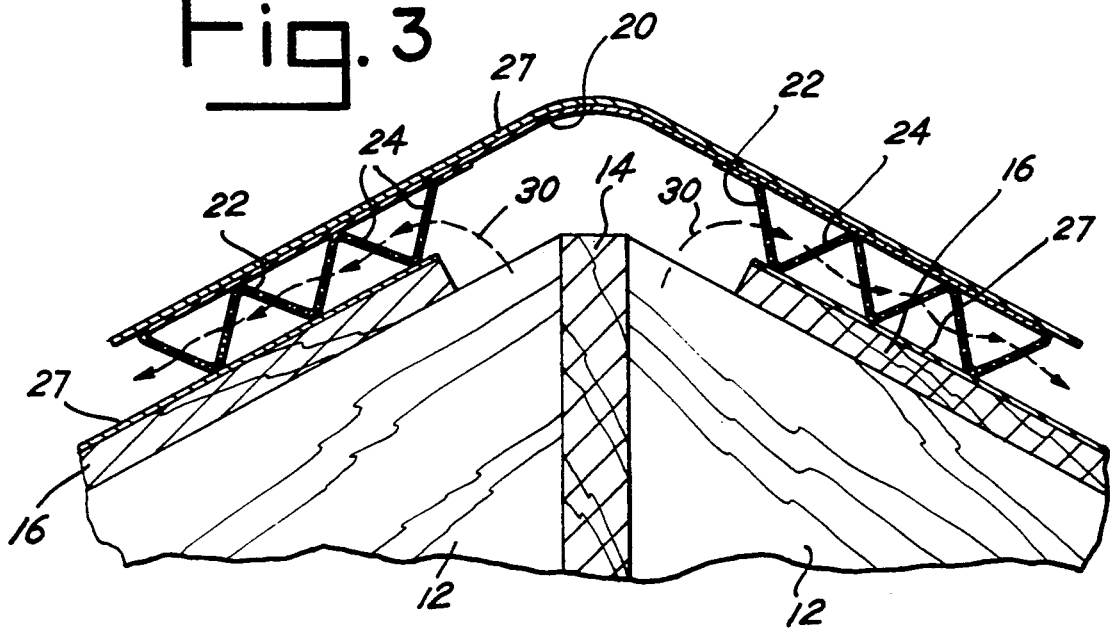
FIG. 3 is a sectional view taken along line 3—3 of FIG.

Ridge vent 10 includes a one-piece cover plate 20 and baffles 22 formed of flexible metal or plastic. Baffles 22 are preferably shaped with rounded edges as shown in the drawings and include a plurality of holes 24 to allow for air flow communication between the interior of a structure (not shown) and the outside air through vent opening 18. Vent 10 is secured to sheathing 16 by conventional fasteners 26. Roof covering material 27, such as shingles or other commercially available roof coverings overlies cover plate 20 and is secured to the cover plate and to sheathing 16 by fasteners 28. With vent 10 positioned over vent opening 18 as shown in FIG. 3, free air flow (depicted by arrows 30) is realized while the interior of the structure (not shown) is shielded against ingress of moisture.

It is understood that the above description does not limit the invention to those details, which may be modified within the scope of the following claims.

I claim:

1. A vent for a roof ridge, said vent constituting means for allowing air flow through a vent opening in a roof to the outside, said vent comprising an upper cover plate having a continuous flat upper surface, a plurality of curved ridges formed integrally with said cover plate and underlying said cover plate when positioned on said roof ridge, said curved ridges having a plurality of holes formed therethough for allowing air flow through a vent opening in a roof to the outside, and fastening means extending through said cover plate and said integral curved ridges for securing said vent to said roof.

2. The vent of claim 1 wherein each baffle means includes rounds edges in abutment with said roof and said cover plate.

3. The vent of claim 1 wherein said cover plate is solid and constitutes means for preventing moisture ingress therethrough to said vent opening.

* * * * *